United States Patent [19]

Marass

[11] 3,951,401

[45] Apr. 20, 1976

[54] DEVICE FOR CHANGING STACKS CONTINUOUSLY OPERATED SHEET FEEDING MACHINES

[75] Inventor: Josef Marass, Seehausen, Germany

[73] Assignee: Georg Spiess GmbH, Gersthofen, Germany

[22] Filed: June 11, 1975

[21] Appl. No.: 586,068

[30] Foreign Application Priority Data

Feb. 12, 1975 Germany ..... 2505762

[52] U.S. Cl. ..... 271/158

[51] Int. Cl.[2] ..... B65H 1/30

[58] Field of Search ..... 271/157–159, 189; 214/6 DK, 8.5 A

[56] References Cited

UNITED STATES PATENTS

| | | | |
|---|---|---|---|
| 2,950,107 | 8/1960 | Royer | 271/158 |
| 2,958,527 | 11/1960 | Seel | 271/158 |
| 2,960,243 | 11/1960 | Beaulieu | 271/218 |
| 3,211,449 | 10/1965 | Welhouse | 271/158 |

*Primary Examiner*—John J. Love
*Assistant Examiner*—Robert Saifer
*Attorney, Agent, or Firm*—Webb, Burden, Robinson & Webb

[57] ABSTRACT

A fork-like stack changing table arranged to support a residual stack and to be withdrawn when the next stack is raised to it. Sealing strips seal the space between the stacks and the fork rods and means are provided for applying compressed air to the space between stacks. In this way, the residual stack bears lightly upon the auxiliary table and it can be withdrawn permitting the main stack to join the residual stack.

6 Claims, 4 Drawing Figures

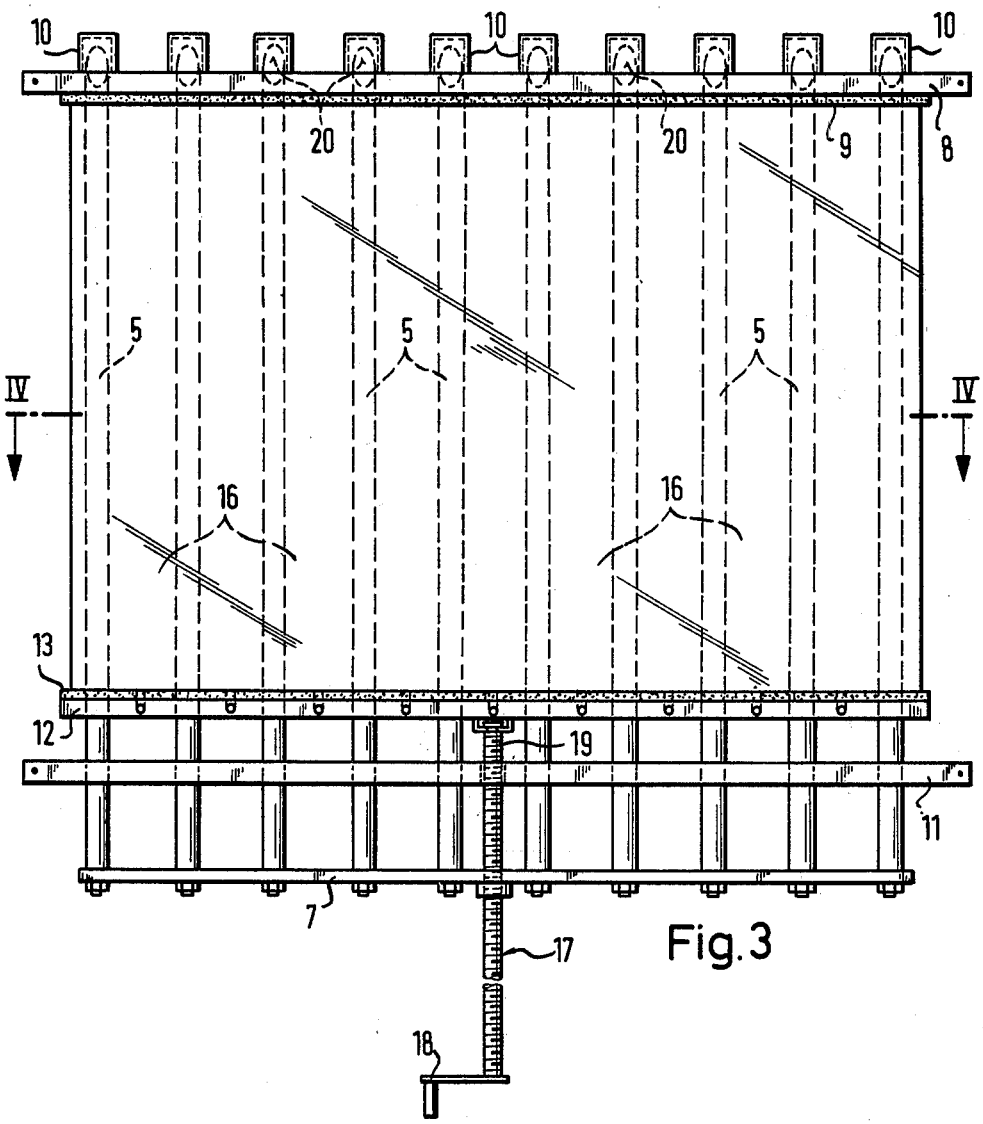
Fig.3
Fig.4
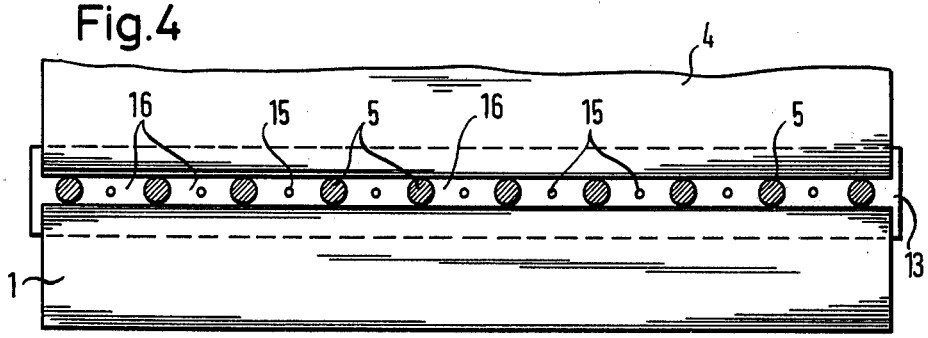

DEVICE FOR CHANGING STACKS CONTINUOUSLY OPERATED SHEET FEEDING MACHINES

This invention relates to devices for changing stacks in continuously operating sheet feeding machines in which an auxiliary stack table carrying a residual stack can be withdrawn laterally for the purpose of combining the residual stack with the following stack.

Prior auxiliary stack tables are equipped, for example, with driven or idling rollers. These rollers require bearings on a support frame and this leads to a corresponding expense and to an undesirable structural height. Somewhat simpler are rake-like auxiliary stack tables which are formed of rods that are rigidly connected with one another at their one end. In order to reduce friction during their withdrawal, tubes have been used in place of solid rods, the outside of the said tubes being provided with a plurality of openings through which compressed air is forced. However, in order to ensure adequate carrying capacity, tubes with a rather large diameter are required, and this leads to a greater height for the auxiliary stack table and, consequently, also a marked drop in the residual stack when the auxiliary stack table is withdrawn. Moreover, high capacity compressed air sources are required to provide the air which is constantly flowing from the perforated tubes. Another drawback of this is that paper dust is blown about by the air stream.

It is an object of this invention to provide for introducing air between the main stack and the residual stack to reduce friction when the auxiliary stack table is withdrawn, without the use of high-pressure, constantly escaping, dust generating compressed air.

Briefly, according to this invention, sealing strips are disposed at right angles to rods comprising a rake-like auxiliary stack table. The said strips have openings for the passage therethrough of the rods of the rake and are capable of being pressed against the two stacks in such a way that hollow chambers are formed between the rods of the rake. The chambers are sealed off from the outside air. Now, the compressed air is no longer constantly blown through the perforated shells of the hollow rods. It is introduced into chambers that are disposed between the rods.

The sealing strip on the one side of the stack may be formed by the crossbeam of the stack lifting device. The crossbeam is coated with a sealing material. The sealing strip on the other side of the stack is formed by a strip that is coated with sealing material and is adjustable relative to the stack. Preferably, the adjustment of this sealing strip relative to the stack is effected by means of a spindle which is rotatably mounted in the crossbar that connects the rods of the rake with one another.

The pipe for passing the compressed air is mounted on the adjustable sealing strip and extends along the full width of the rake. From this feedline, branchlines lead off into the hollow chambers formed between adjacent rods of the rake.

In order to avoid loss of compressed air, the openings in the crossbeam that receive the free ends of the rods of the rake are closed. The free ends of the rods that form the rake are beveled on one side in such a manner that at the end of the rod along inclined surface is formed which faces the residual stack.

Since, as the result of this sealing, the loss caused by the escape of compressed air is only slight, the compressor which is on hand in any case in a sheet feeder, is adequate for operating the device of the invention.

Further features and other objects and advantages will become clear from the following detailed description made with reference to the drawings in which:

FIG. 3 is a plan view of the auxiliary stack table; and

FIG. 4 is a section taken along line IV-IV of FIG. 3.

Generally speaking, in a device according to this invention, one stack (referred to herein as the main stack) is raised to the bottom of another stack being fed (referred to herein as the residual stack). The support for the residual stack is then withdrawn and the main stack becomes the support thereon. Upon depletion, one main stack becomes the next residual stack. A system for raising the main stack to the residual stack and withdrawing the support therebetween is set forth in my copending applications filed of even date herewith entitled "Stack Changer in Continuously Operated Sheet Feeding Machines" and "Lifting Device for Sheet Feeding Machines."

Figure 1:
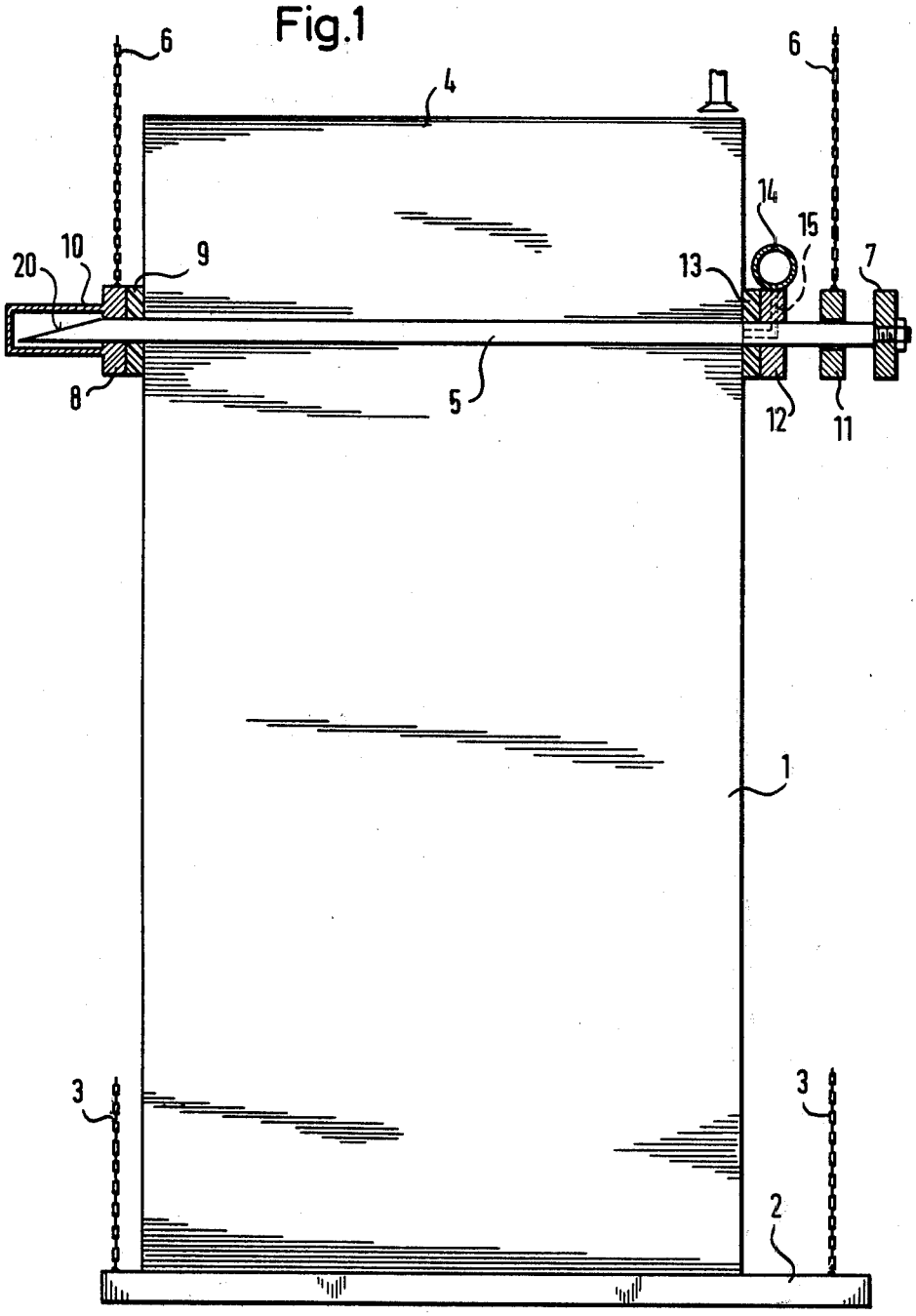
FIG. 1 shows a device according to this invention in an operational stage in which the residual stack is still supported completely by the auxiliary stack table.
Figure 2:
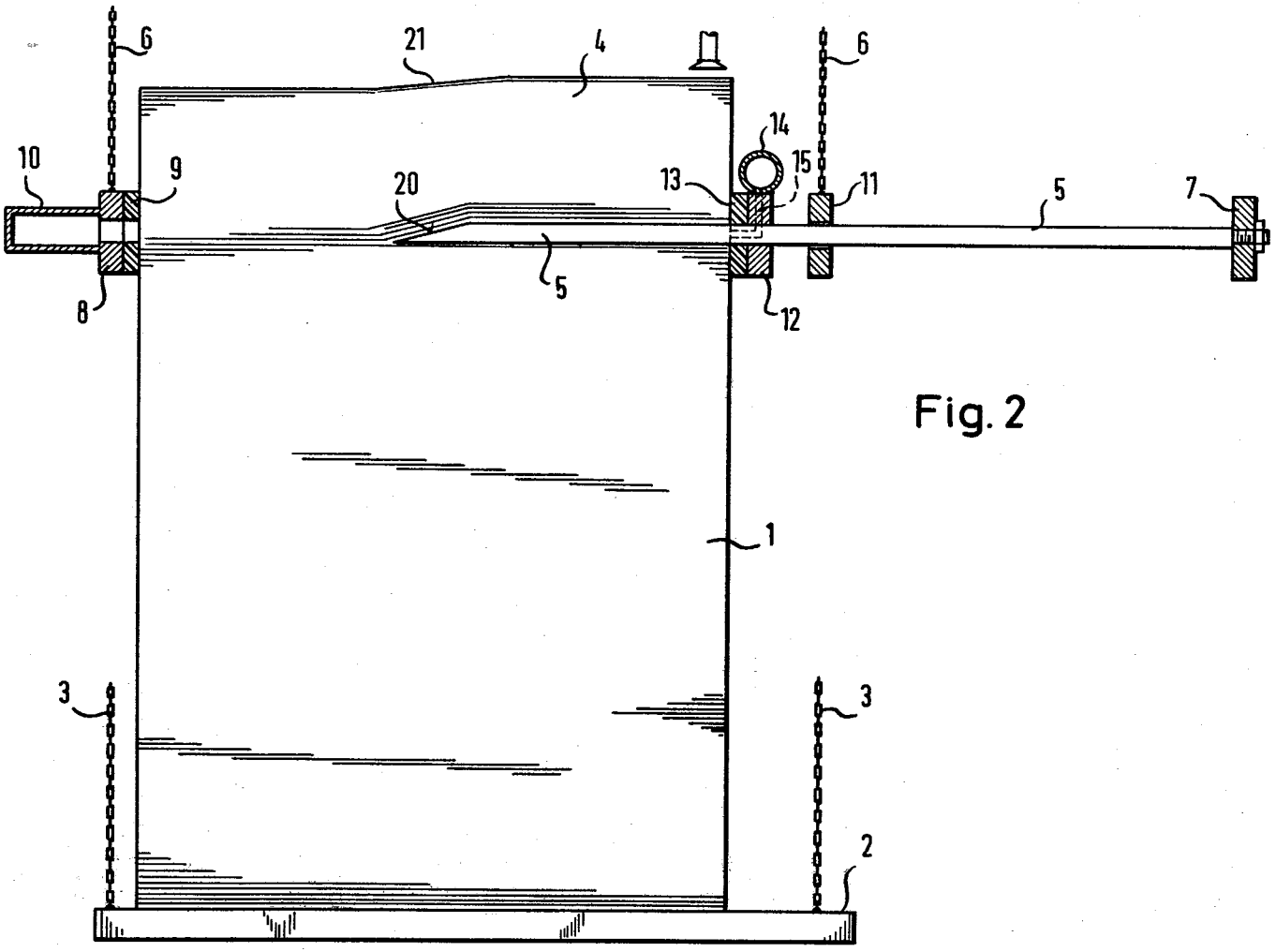
FIG. 2 shows the same device in the course of the withdrawal of the auxiliary stack table.

In FIG. 1, the main stack 1 rests on stack table 2 with the lifting mechanism indicated at 3, while the residual stack 4 is still resting completely on the auxiliary stack table with lifting mechanism 6. This auxiliary stack table consists of a number of parallel, preferably solid rods 5 which are rigidly connected to one another by means of crossbar 7. Crossbeam 8 of lifting mechanism 6 for the auxiliary stack table is coated with a sealing material 9, such as rubber sponge, on its side that faces the stack. The openings of this crossbeam which receive the free ends of rods 5 are sealed by caps 10. On the other side of the stack is a second sealing strip 12 which is independent of crossmember 11 and is provided with a sealing material 13. The second sealing strip moves relative to the rake during the withdrawal thereof to maintain contact with the residual and main stacks. On this sealing strip, a tube-like compressed-air supply line 14 is mounted, which extends over the entire width of the auxiliary stack table and is connected by means of branchlines 15 that run at right angles to the supply line to hollow chambers 16 formed between rake rods 5.

The spindle 17 with crank handle 18 is threadably mounted in crossbar 7 which connects rods 5 to one another. Its free end 19 is rotatably mounted on sealing strip 12. It passes through crossmember 11 without engaging it. In this way by turning spindle 17, it is possible to bring sealing strip 12 with its sealing material 13 into abutment against the two stacks 1 and 4. By further rotation of spindle 17 the whole rakelike auxiliary stack table is withdrawn from between the two stacks, while preserving the tight abutment of strips 12 and 13 against stacks 1 and 4. On their one side, rods 5 are beveled in such a way that a long, inclined surface 20 is formed at the end of the rod, the said inclined surface facing residual stack 4 in order to ensure the smoothest possible drop 21 of residual stack 4 progressing from one side of the stack to the other.

Due to the air cushions formed between rods 5, residual stack 4 rests lightly upon the rods 5 being withdrawn. Furthermore, the solid construction of rods 5 permits a minimum structural height of the auxiliary stack table.

Having thus described my invention with the detail and particularity as required by the patent laws, which is desired protected by Letters Patent is set forth in the following claims:

1. In a device for changing stacks in continuously operating sheet feeding machines comprising a rake-like auxiliary stack table formed of parallel rods that are rigidly connected to one another at their one end and which can be inserted under the residual stack before the main stack is raised up to it, the improvement comprising said rake-like auxiliary stack table comprising at right angles to the rods (5) sealing strips (8,12) having openings for the passage therethrough of the rods (5) of the rake, said strips being pressable from without, against the two stacks (1,4) in such a manner that they seal off chambers (16) formed between the rods (5) of the make and means for introducing a blast of air between the main stack and the residual stack.

2. The improvement according to claim 1 in which the sealing strip (8) on one side of the stacks is formed by a crossbeam of the stack lifting mechanism (6), the said crossbeam being coated with a sealing material (9) and the sealing strip (12) on the other side of the stacks is formed of a strip that is coated with a sealing material (13) and is adjustable relative to the stack.

3. The improvement according to claim 2 in which the adjustment of the one sealing strip (12) relative to the stack is effected by a spindle engaging said strip (17) rotatably mounted in a crossbar (7) connecting the rods of the rake to one another.

4. The improvement according to claim 3 in which a compressedair supply line (14) is mounted on the adjustable sealing strip (12) and extends over the entire width of the rake and from which branchlines (15) extend which lead to the said chambers (16) formed between the rods (5) of the rake.

5. The improvement according to claim 4, in which capped openings are formed in the sealing strip for receiving the free ends of the rake rods (5) that are formed by a crossbeam of the lifting mechanism (6).

6. The improvement according to claim 5 in which the rake rods (5) are beveled on one side at their free end in such a way that a long, inclined surface (20) is formed on the end of the rod facing the residual stack (4).

* * * * *

UNITED STATES PATENT OFFICE
CERTIFICATE OF CORRECTION

PATENT NO. : 3,951,401

DATED : April 20, 1976

INVENTOR(S) : Josef Marass

It is certified that error appears in the above-identified patent and that said Letters Patent are hereby corrected as shown below:

In the Title - On page 1 and page 2

After "STACKS" insert "IN"

Column 2 Line 18 "thereon" should read --therefor--.

Claim 1 - Column 3 Line 17 "make" should read --rake--.

Signed and Sealed this

Sixth Day of July 1976

[SEAL]

*Attest:*

RUTH C. MASON
*Attesting Officer*

C. MARSHALL DANN
*Commissioner of Patents and Trademarks*